US008297950B2

(12) United States Patent
Horng

(10) Patent No.: US 8,297,950 B2
(45) Date of Patent: Oct. 30, 2012

(54) FAN

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 301 days.

(21) Appl. No.: 12/538,204

(22) Filed: Aug. 10, 2009

(65) Prior Publication Data

US 2011/0033323 A1 Feb. 10, 2011

(51) Int. Cl.
*F04D 25/06* (2006.01)

(52) U.S. Cl. ..... 417/423.14; 417/423.7

(58) Field of Classification Search ..... 417/423.7, 417/423.14, 423.1; 415/200
See application file for complete search history.

(56) References Cited

U.S. PATENT DOCUMENTS

| | | | | |
|---|---|---|---|---|
| 4,686,400 | A * | 8/1987 | Fujisaki et al. | 310/67 R |
| 4,773,828 | A * | 9/1988 | Hagiwara et al. | 417/354 |
| 5,189,327 | A * | 2/1993 | Ootsuka et al. | 310/71 |
| 5,699,854 | A * | 12/1997 | Hong | 165/121 |
| 5,947,704 | A | 9/1999 | Hsieh | |
| 5,979,541 | A | 11/1999 | Saito | |
| 6,045,327 | A | 4/2000 | Amr | |
| 6,942,471 | B2 * | 9/2005 | Weisser | 417/423.1 |
| 7,044,721 | B2 * | 5/2006 | Horng et al. | 417/423.7 |
| 7,345,884 | B2 * | 3/2008 | Horng et al. | 361/719 |
| 7,442,005 | B2 * | 10/2008 | Yeh et al. | 415/200 |
| 7,811,069 | B2 * | 10/2010 | Fleig | 417/423.14 |
| 2004/0126248 | A1 | 7/2004 | Hsiao | |
| 2005/0180867 | A1 * | 8/2005 | Takahashi et al. | 417/423.14 |
| 2007/0128022 | A1 * | 6/2007 | Yeh et al. | 415/220 |
| 2007/0178720 | A1 | 8/2007 | Yoshida | |
| 2007/0280840 | A1 * | 12/2007 | Sugiyama et al. | 417/423.5 |
| 2009/0016914 | A1 * | 1/2009 | Chen et al. | 417/423.7 |

FOREIGN PATENT DOCUMENTS

| | | | |
|---|---|---|---|
| CN | 2394032 | Y | 8/2000 |
| CN | 101324240 | A | 12/2008 |
| TW | 443435 | | 6/2001 |
| TW | 449682 | | 8/2001 |
| TW | I340892 | B1 | 4/2011 |

* cited by examiner

*Primary Examiner* — Peter J Bertheaud
(74) *Attorney, Agent, or Firm* — Alan Kamrath; Kamrath IP Lawfirm, PA

(57) ABSTRACT

A fan has a housing with a wire-guiding slot. One of plural connecting members is taken as a line fixed portion having a linking end facing the wire-guiding slot, with the linking end connecting to a section of a peripheral wall of the housing and the section axially aligned with the wire-guiding slot of the housing. A base is coupled to the housing. A power line has one end connected with the connection port and the other end extended beyond the housing via the wire-guiding slot. An impeller is rotatably mounted inside of the housing. Therefore, the line fixed portion can be close to the wire-guiding slot. Thus, the power line can be extended straight through the wire-guiding slot. A distance between the connection port and the wire-guiding slot is shortened to enhance assembling convenience of the power line.

8 Claims, 8 Drawing Sheets

FAN

BACKGROUND OF THE INVENTION

1. Field of the Invention

The present invention relates to a fan and, more particularly, to a fan allowing easy assembly of a power line and including ribs or stationary blades.

2. Description of the Related Art

Conventional fans generally include a power line. The position for fixing the power line must be carefully arranged to avoid the power line from being loosened or being entangled in an impeller of the currently available fan. Moreover, conventional fans can be distinguished into two types. The first type of conventional fans doesn't have a design of a rib or stationary blade. The second type of conventional fans includes a rib or stationary blade. The power line arranging methods for these two types of conventional fans are different.

For example, the first type of heat-dissipating fans is disclosed in Taiwan Patent Publication No. 449682 and Taiwan Patent Publication No. 443435. A channel is formed on a housing so that the power line can directly extend into the channel to connect with an external power source. However, the power line still needs a very complicate winding method leading to inconvenience in assembly. Particularly, the channel and housing can also be named as a wire-guiding channel and a base.

FIG. 1 shows the second type of conventional fans 70 including a wire-positioning mechanism 71, which can be regarded as a rib, and a plurality of air-guiding holes 73. The wire-positioning mechanism 71 includes a bottom 711, two support portions 712, and two stop portions 713. A power line 72 winds through the bottom 711, the support portions 712, and the stop portions 713. An example of such a fan is disclosed in Taiwan Patent Publication No. 502831. When the power line 72 extends to an outer part of the fan 70, the power line 72 won't block the air-guiding holes 73 to affect the air-guiding ability. An end of the power line 72 must be extended from under the fan 70 to the outside and then wind through the bottom 711, the support portions 712, and the stop portions 713 in sequence to avoid the power line 72 blocking the air-guiding holes 73. However, the difficulty of assembly of the power line 72 is increased. Furthermore, the wire-positioning mechanism 71 is complex and, thus, increases the overall costs of the fan 70.

SUMMARY OF THE INVENTION

An objective of the present invention is to provide a fan with ribs, which avoids difficulties and inconvenience in the assembly of the power line.

Another objective of the present invention is to provide a fan with a reduced axial height.

A fan according to the preferred teachings of the present invention includes a housing having a peripheral wall defining a compartment. A shaft seat is provided in the compartment. The peripheral wall includes a wire-guiding slot in communication with the compartment. A plurality of connecting members links the shaft seat and the peripheral wall. One of the connecting members is taken as a line fixed portion while a linking end is axially aligned with the wire-guiding slot. A base is coupled to the housing. The base includes a coil unit and a connection port electrically connected to the coil unit. A power line is located at the line fixed portion. The power line includes one end connected with the connection port while the other end extends beyond the housing via the wire-guiding slot. An impeller includes a hub, a shaft, and a permanent magnet, with both the shaft and the permanent magnet are mounted to the hub. The shaft is coupled to the shaft seat, and the permanent magnet having a magnet face faces the coil unit. Thus, the line fixed portion can be as close to the wire-guiding slot as possible. As a result, the power line can extend straight beyond the housing from the connection port, and the circuitous extension of the power line inside the housing for reaching the wire-guiding slot is needless, so that assembling convenience can be enhanced.

In preferred forms, a linking end of the line fixed portion is located on a straight reference line passing through the shaft seat and the wire-guiding slot. A distance between the connection port and the wire-guiding slot is shortened to enhance assembling convenience of the power line.

In preferred forms, the connection port of the base is located outside of a radially rotational area of the permanent magnet, and the connection port is intermediate an outer periphery of the permanent magnet and an inner peripheral face of the peripheral wall of the housing. Thus, a spacing between the permanent magnet and the base can be shortened, since the connection port and the power line are not located in the spacing. Thus, the axial height of the fan can be reduced.

In preferred forms, the line fixed portion with a linking end is located on a straight reference line passing through the shaft seat and the wire-guiding slot. An extension is formed at an outer periphery of the base. The extension extends radially outward from the outer periphery of the base towards the wire-guiding slot. The connection port is formed on a surface of the extension. Thereby, the connection port can be closer to the wire-guiding slot so that the power line can extend through the wire-guiding slot easily. Thus, assembling convenience of the power line can be further enhanced.

In preferred forms, a positioning member is engaged in the wire-guiding slot. The wire-guiding slot includes a first pressing surface. The positioning member includes a second pressing surface. The power line is clamped between the first and second pressing surfaces, reliably positioning the power line.

In preferred forms, the first pressing surface of the wire-guiding slot includes a first stepped portion, and the second pressing surface of the positioning member includes a second stepped portion facing and engaged with the second stepped portion, preventing the power line from being pulled off the power connection port.

In preferred forms, the wire-guiding slot is located in a corner of the peripheral wall of the housing. Therefore, a distance between the connection port and the wire-guiding slot can be shortened, so that the power line can extend beyond the housing via the wire-guiding slot.

In preferred forms, the housing includes a bottom wall formed inside the peripheral wall and defining the compartment. A plurality of catches is formed on the bottom wall and located in the compartment. The base is mounted in the compartment and abuts the bottom wall. The catches engage with an outer periphery of the base to enhance coupling ability of the base with the housing.

In preferred forms, the coil unit is formed on a surface of the base by layout to shorten an axial length of the base.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
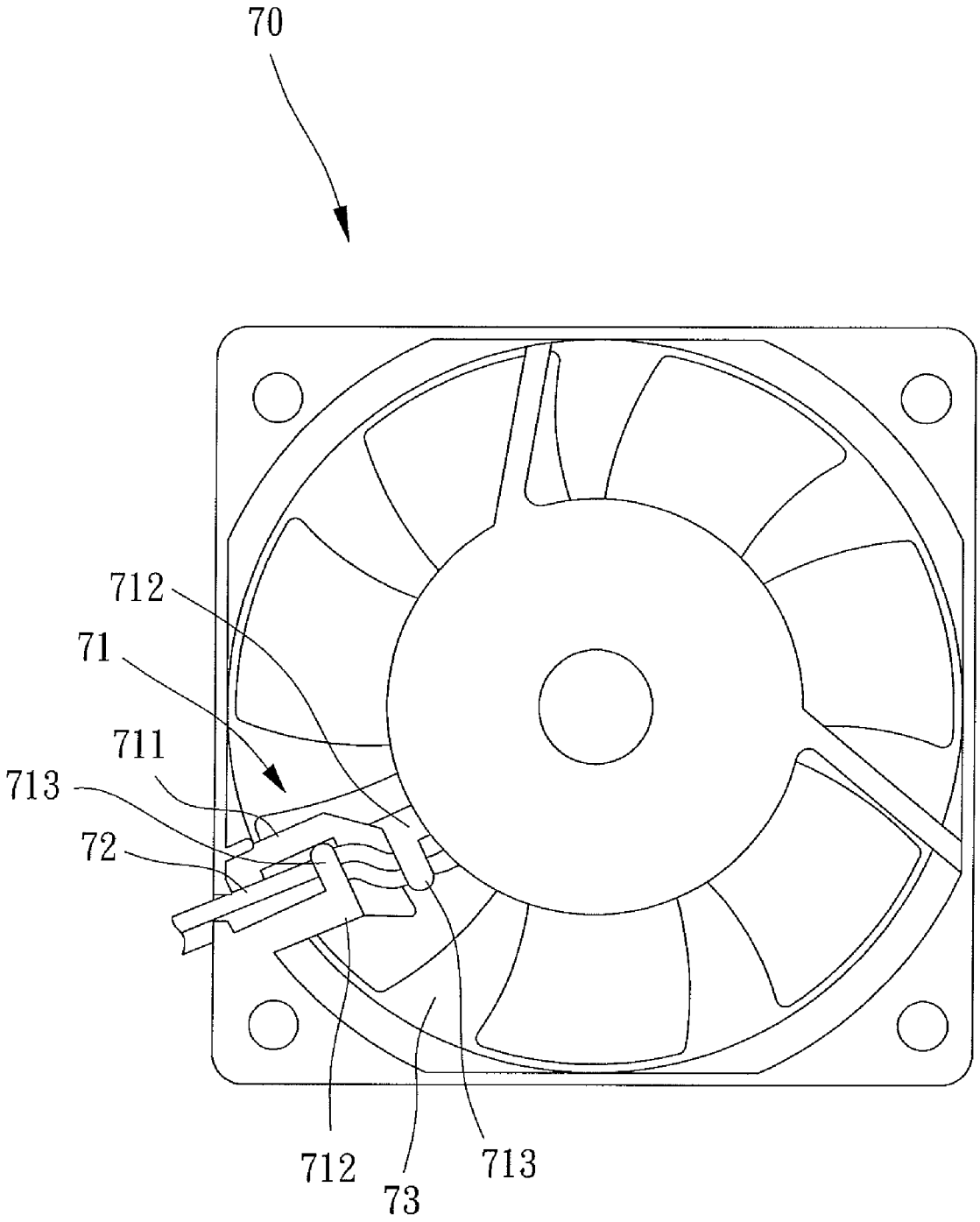
FIG. 1 PRIOR ART
FIG. 1 shows a bottom view of a conventional fan.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "end", "radial", "axial", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
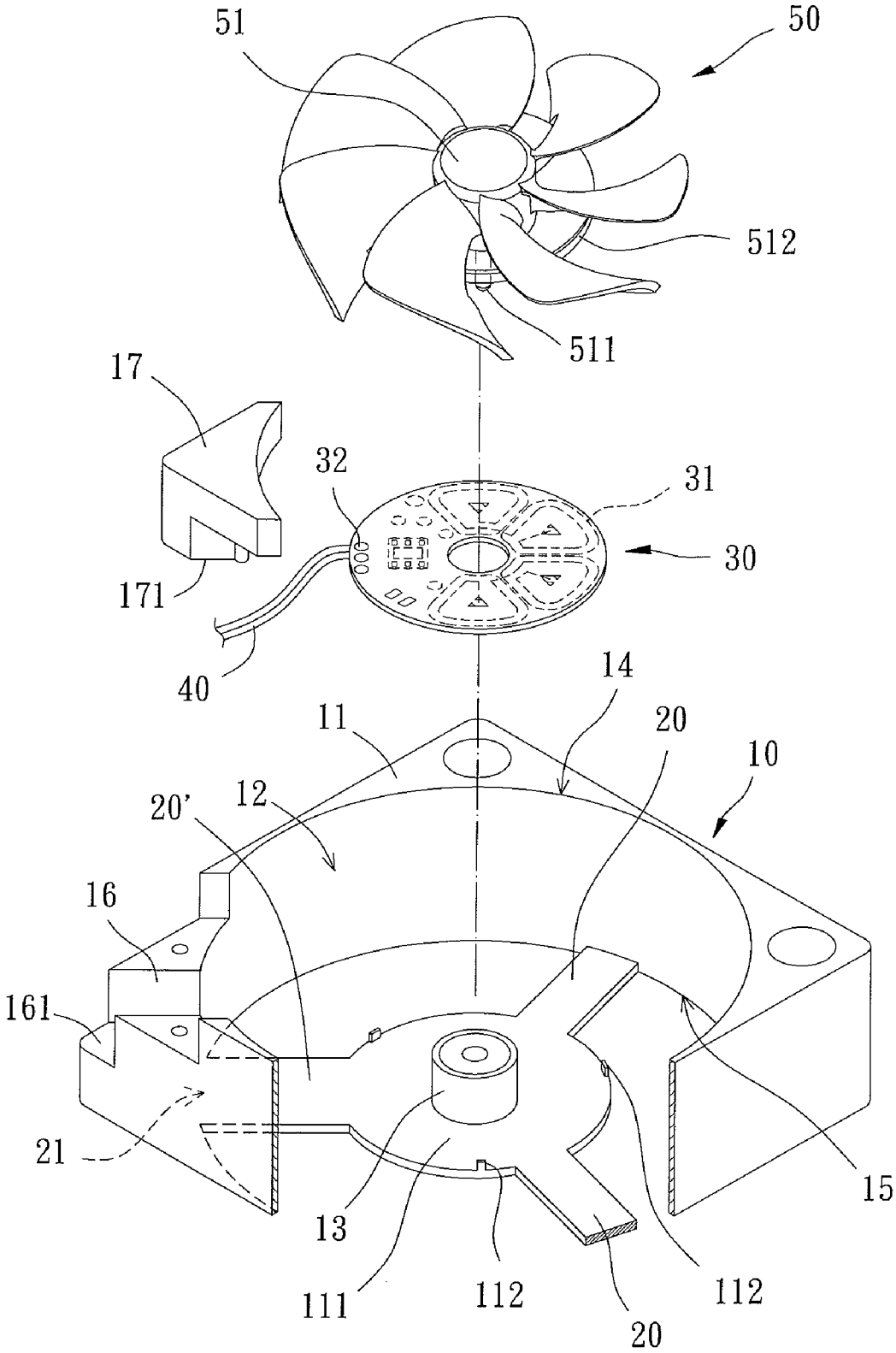
FIG. 2 shows an exploded, perspective view of a fan of the embodiment according to the preferred teachings of the present invention.
Figure 3:
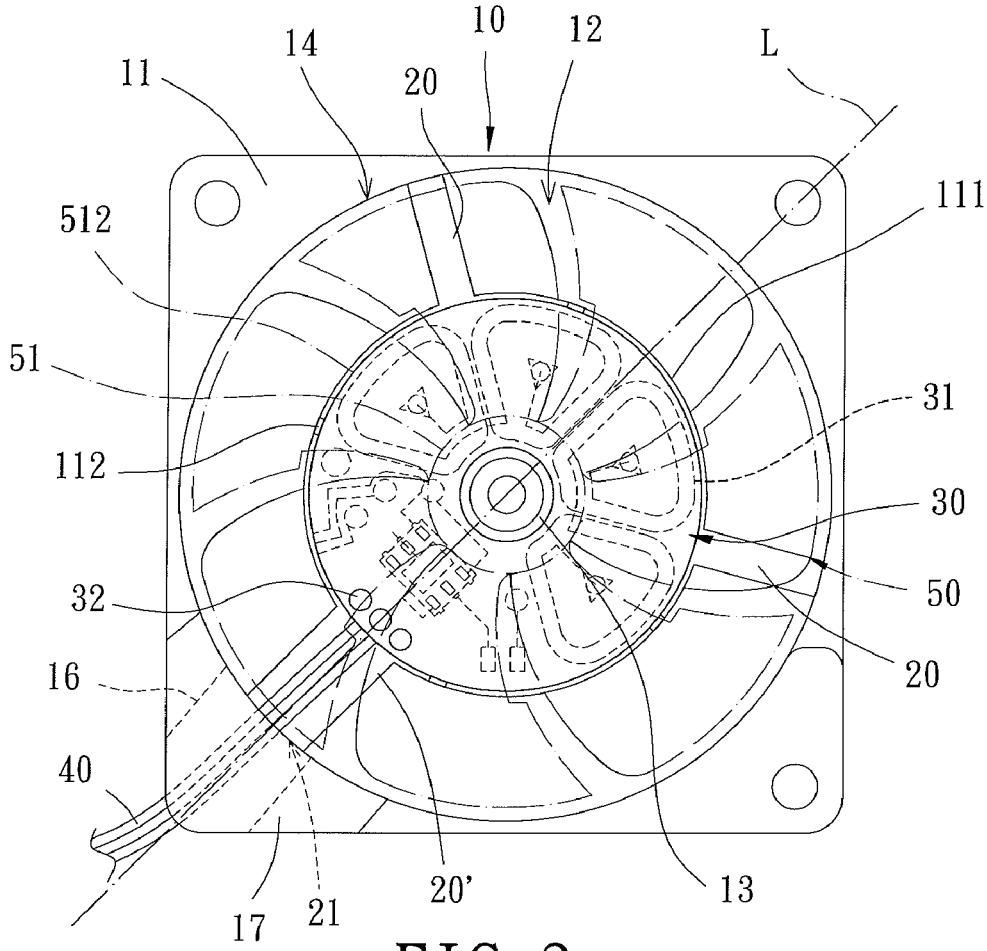
FIG. 3 shows a top view of the fan of FIG. 2

A fan of a first embodiment according to the preferred teachings of the present invention is shown in FIGS. 2 and 3. The fan includes a housing 10, a plurality of connecting members 20, a base 30, a power line 40, and an impeller 50. The housing 10 includes a peripheral wall 11 defining a compartment 12. A shaft seat 13 is provided in the compartment 12. The housing 10 further includes an air inlet 14 and an air outlet 15 both in communication with the compartment 12. The peripheral wall 11 includes a wire-guiding slot 16 in communication with the compartment 12. Preferably, the wire-guiding slot 16 is located in a corner of the peripheral wall 11 of the housing 10. The housing 10 further includes a bottom wall 111 formed inside the peripheral wall 11 and defining the compartment 12. A plurality of catches 112 is formed on the bottom wall 111 located in the compartment 12. Besides, the shaft seat 13 is preferably mounted on the bottom wall 111 and located between the catches 112.

The plurality of connecting members 20 links the shaft seat 13 and the peripheral wall 11. One of the connecting members 20 is taken as a line fixed portion 20' having a linking end 21 facing the wire-guiding slot 16, while the linking end 21 connects to a section of the peripheral wall 11, which is axially aligned with the wire-guiding slot 16 of the housing 10. Preferably, since the shaft seat 13 is mounted on the bottom wall 111, one end of each connecting member 20 connects to the shaft seat 13 through the bottom wall 111, while the other end thereof connects to the peripheral wall 11.

The base 30 is mounted in the compartment 12 of the housing 10 and is preferably coupled to the shaft seat 13. The base 30 abuts the bottom wall 111, and the catches 112 engage with an outer periphery of the base 30 to fix the base 30 in place. The base 30 includes a coil unit 31 and a connection port 32 electrically connected to the coil unit 31. Preferably, the coil unit 31 is formed on a face of the base 30 by layout or other suitable provisions to reduce an axial height of the base 30.

The power line 40 extends along the line fixed portion 20' to prevent the power line 40 from blocking the air outlet 15 of the housing 10 and ensure air-guiding efficiency. The power line 40 is preferably further attached and fixed to a surface of the line fixed portion 20' to prevent the power line 40 from disengagement. The power line 40 and the line fixed portion 20' can be fixed by glue, clamps or suitable fasteners. Moreover, one end of the power line 40 connects with the connection port 32 of the base 30 while the other end of the power line 40 is extended beyond the housing 10 via the wire-guiding slot 16 for connection with an external power source. The power line 40 can be fixed in the wire-guiding slot 16 such as by glue or fasteners. Thus, the power line 40 can supply electric current to the coil unit 31 of the base 30 for driving the impeller 50.

The impeller 50 includes a hub 51. A shaft 511 and a permanent magnet 512 are mounted to the hub 51. The shaft 511 is coupled to the shaft seat 13, so that the impeller 50 is rotatable in the compartment 12 of the housing 10 about an axis. The permanent magnet 512 has a magnet face facing the coil unit 31.

In use, the coil unit 31 interacts with the permanent magnet 512 to drive the impeller 50 to rotate. Air currents are driven by the impeller 50 into the compartment 12 via the air inlet 14 and then exit the housing 10 via the air outlet 15 to proceed with heat dissipation. Thus, the fan according to the preferred teachings of the present invention can be mounted in differing electronic devices or equipment and provide desired heat-dissipating effect.

With the above-mentioned structure, the present invention provides the following feature. The line fixed portion 20' can be as close to the wire-guiding slot 16 as possible, since the line fixed portion 20' with a linking end 21 facing the wire-guiding slot 16 is selected from one of the connecting members 20. Accordingly, by extending along the line fixed portion 20', the power line 40 connects with the connection port 32 with one end and directly extends beyond the housing 10 through the wire-guiding slot 16 with the other end. Thus, the power line 40 can extend straight beyond the housing 10 from the connection port 32, and the circuitous extension of the power line 40 inside the housing 10 for reaching the wire-guiding slot 16 is needless. Preferably, the power line 40 is firmly fixed by the line fixed portion 20' to improve assembling convenience so that the power line 40 can be extended straight through the wire-guiding slot 16, enhancing assembling convenience and reliably preventing the power line 40 from being entangled into the impeller 50 during operation of the fan according to the preferred teachings of the present invention.

In the preferred form shown in FIGS. 2 and 3, a straight reference line L passing through the shaft seat 13 and the wire-guiding slot 16 is defined, and the line fixed portion 20' with the linking end 21 is preferably located on the reference line L while the connection port 32 of the base 30 faces the wire-guiding slot 16 of the housing 10. Thereby, since the connection port 32 is close to the wire-guiding slot 16, a route between the wire-guiding slot 16 and the connection port 32, on which the power line 40 extends, is not only straight but also short, so that the assembling convenience of the power line 40 is improved.

In the preferred form shown in FIGS. 2 and 3, a positioning member 17 is engaged in the wire-guiding slot 16 of the housing 10. The wire-guiding slot 16 includes a first pressing surface 161, and the positioning member 17 includes a second pressing surface 171. After the power line 40 is extended through the wire-guiding slot 16, the positioning member 17 is engaged in the wire-guiding slot 16 so that the power line 40 is clamped between the first and second pressing surfaces 161 and 171, enhancing the positioning effect for the power line 40. Thus, undesired disengagement of the end of the power line 40 from the connection port 32 is avoided.

Figure 4:
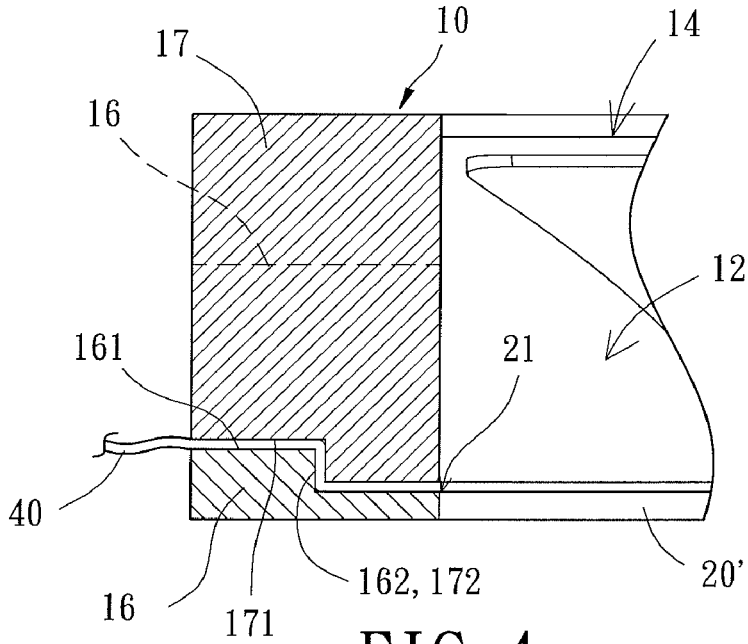
FIG. 4 shows an exploded, perspective view illustrating positioning of a power line by a positioning member of the fan according to the preferred teachings of the present invention.

In a preferred form shown in FIG. 4, the first pressing surface 161 of the wire-guiding slot 16 includes a first stepped portion 162, and the second pressing surface 171 of the positioning member 17 includes a second stepped portion 172 engaged with the first stepped portion 162. Thus, when the power line 40 is clamped between the first and second pressing surfaces 161 and 171, the power line 40 has a bend at the first and second stepped portions 162 and 172 to provide an anti-pulling effect. Thus, disengagement of the end of the power line 40 from the connection port 32 resulting from pulling the power line 40 can be avoided.

Figure 5:
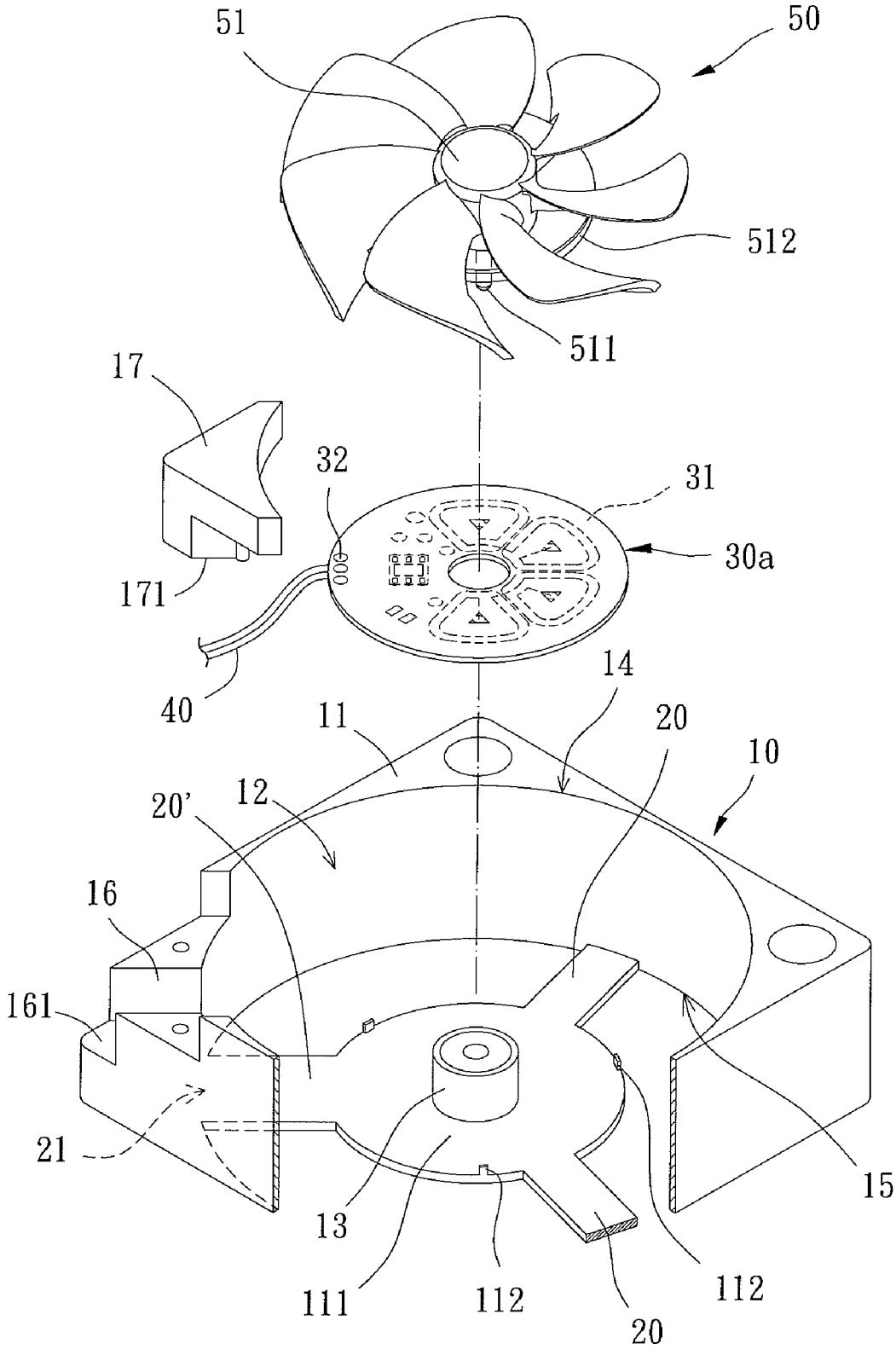
FIG. 5 shows an exploded, perspective view of a fan with a connection port outside of the permanent magnet of the base of the fan according to the preferred teachings of the present invention.
Figure 6:
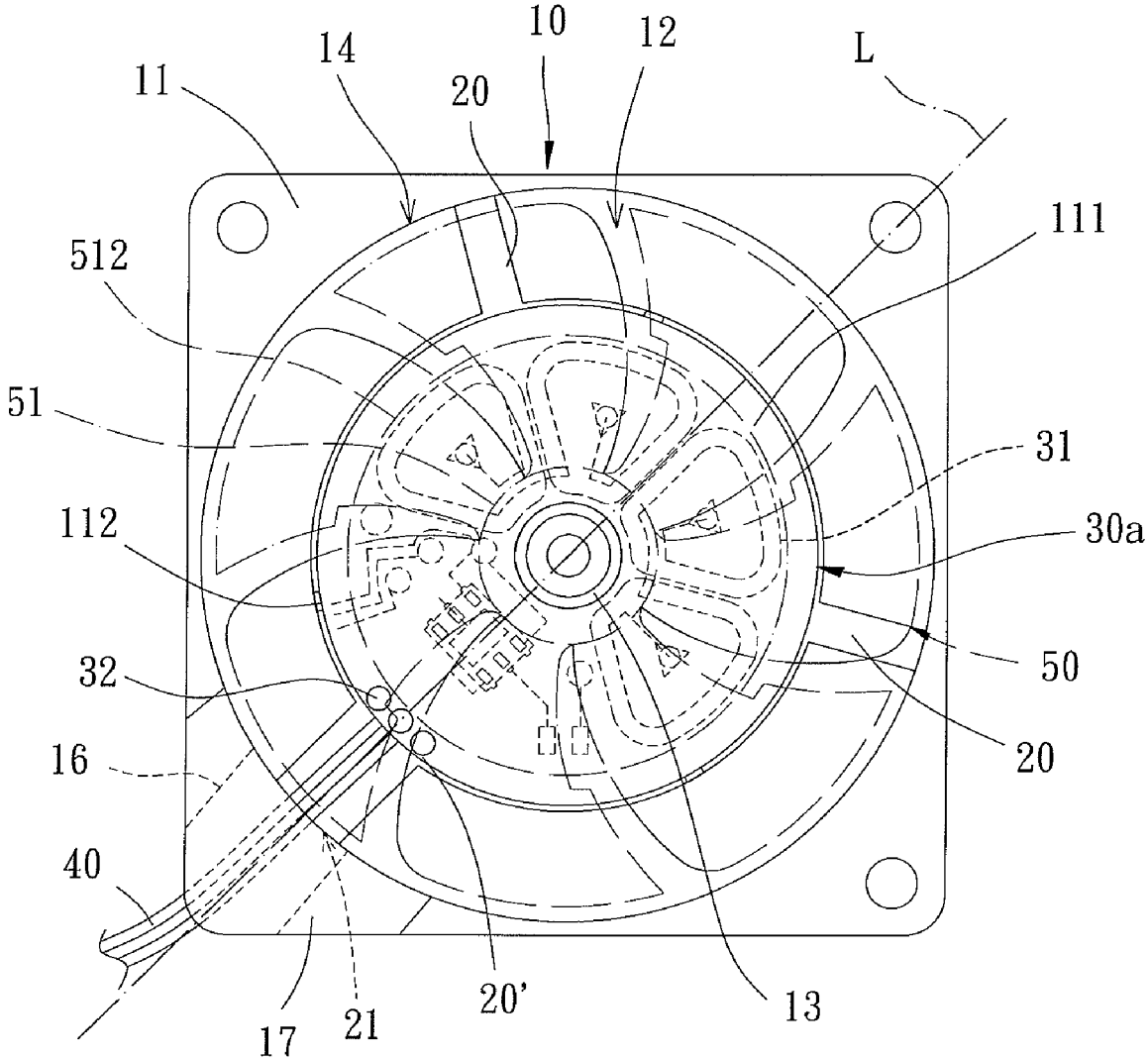
FIG. 6 shows a top view of the fan of FIG. 5.
Figure 7:
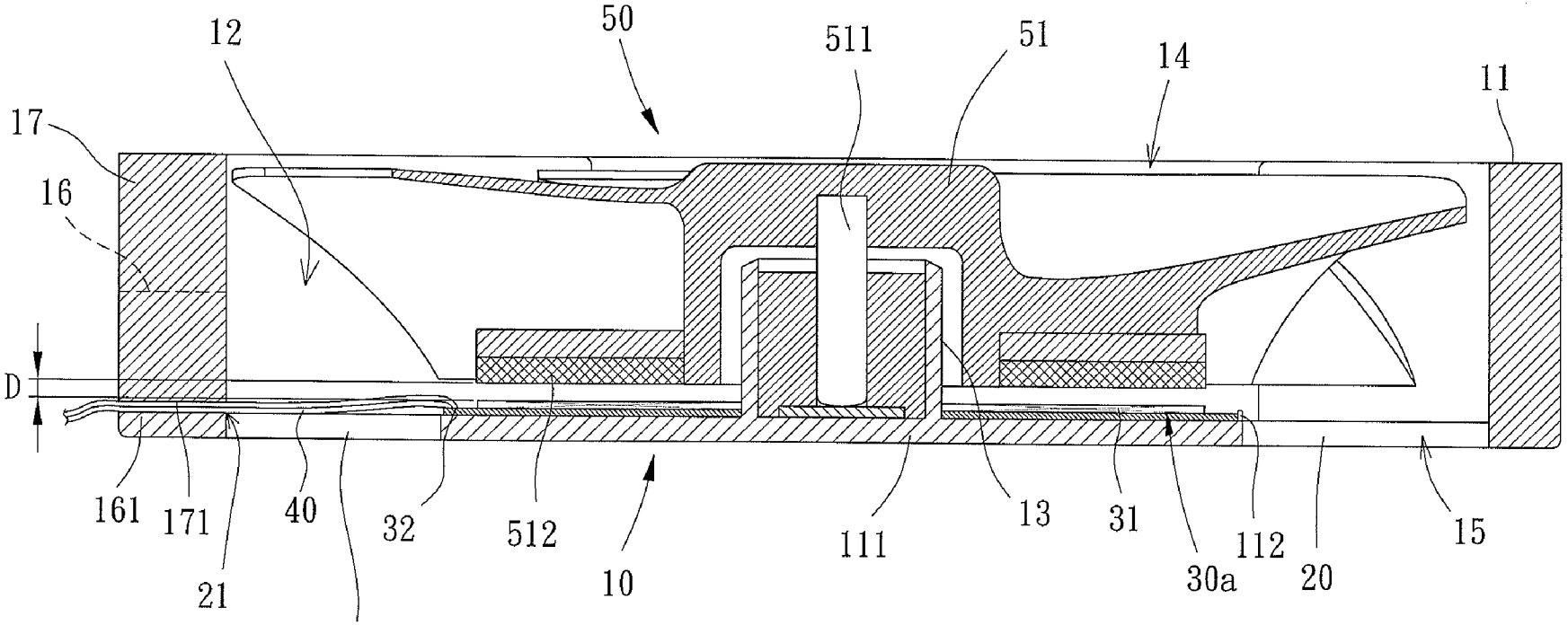
FIG. 7 shows a cross sectional view of the fan of FIG. 5.

FIGS. 5 and 6 show a base 30*a* of a fan of a second embodiment according to the preferred teachings of the present invention. The connection port 32 of the base 30*a* is located outside of a radially rotational area of the permanent magnet 512. That is, a distance between the shaft 511 and the connection port 32 is larger than that between the shaft 511 and an outer circumference of the permanent magnet 512. Specifically, the connection port 32 is radially between an outer periphery of the permanent magnet 512 and an inner peripheral face of the peripheral wall 11 of the housing 10. Furthermore, a spacing D (FIG. 7) between the permanent magnet 512 of the impeller 50 and the base 30*a* can be shortened, since the connection port 32 and the power line 40 are not located in the spacing D. Thus, the overall axial height of the fan along the axis can be reduced.

Figure 8:
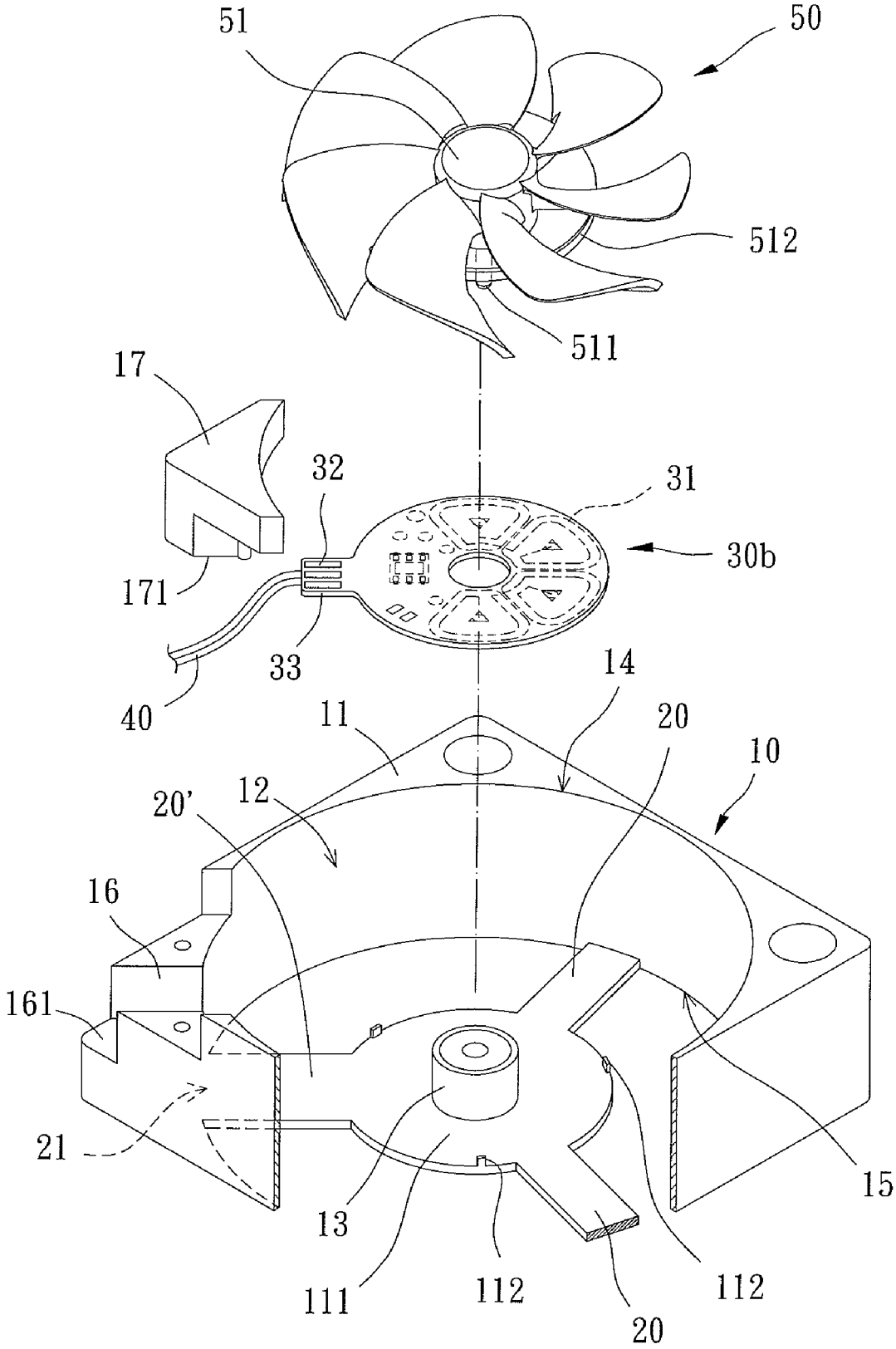
FIG. 8 shows an exploded, perspective view of a fan with an extension of the base of the fan according to the preferred teachings of the present invention.
Figure 9:
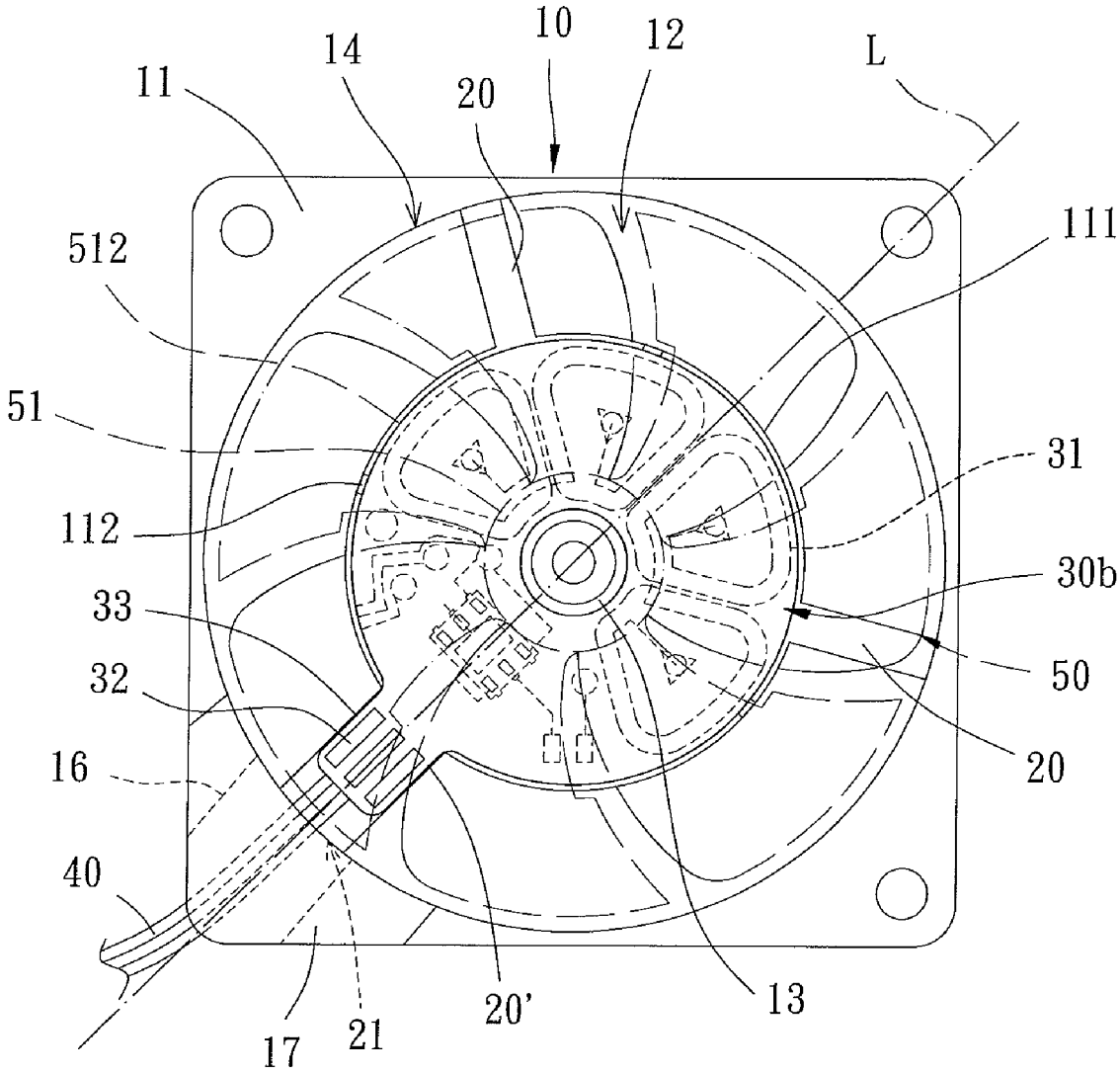
FIG. 9 shows a top view of the fan of FIG. 8.

FIGS. 8 and 9 show a base 30*b* of a fan of a third embodiment according to the preferred teachings of the present invention. The linking end 21 of the line fixed portion 20' is preferably located on the reference line L. According to the position of the line fixed portion 20', an extension 33 is formed at an outer periphery of the base 30*b*, with the extension 33 extending toward the wire-guiding slot 16 of the housing 10 and also located on the reference line L. Moreover, the extension 33 can be coupled to the line fixed portion 20', and the connection port 32 is formed on a face of the extension 33. Furthermore, by providing the extension 33 of the base 30*b*, the connection port 32 of the base 30*b* is located outside of the radially rotational area of the permanent magnet 512 of the impeller 50. Further, the connection port 32 is closer to the wire-guiding slot 16, so that straight insertion of the power line 40 through the wire-guiding slot 16 is easier, further enhancing the assembling convenience of the power line 40.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A fan comprising, in combination:

a housing having a first side and a second side spaced from the first side along an axis, wherein the housing includes a peripheral wall extending from the first side to the second side along the axis, wherein the peripheral wall has an inner periphery and an outer periphery, wherein the inner periphery extends from the first side to the second side to define a cylindrical compartment, wherein a shaft seat is provided in the cylindrical compartment, wherein the peripheral wall includes a wire-guiding slot in communication with the cylindrical compartment, wherein the outer periphery has quadrilateral cross sections including four faces, wherein the housing has a radial thickness between the inner and outer peripheries of the peripheral wall, said radial thickness being largest at positions where adjacent faces of the outer periphery connect to each other, and wherein the wire-guiding slot extends from the inner periphery to the outer periphery at one of the positions where adjacent faces of the outer periphery connect to each other;

an impeller including a hub, a shaft, and a permanent magnet, wherein both of the shaft and the permanent magnet are mounted to the hub, wherein the shaft is rotatably coupled to the shaft seat about an axis;

a plurality of circumferentially spaced connecting members extending along radial lines from the axis and linking the shaft seat and the peripheral wall at the first side of the housing, wherein one of the plurality of circumferentially spaced connecting members extends along a corresponding radial line from the axis to the peripheral wall and is aligned with the wire-guiding slot of the housing, wherein the wire-guiding slot extends parallel to the corresponding radial line, wherein the wire-guiding slot extends through housing from the second side towards the first side and ends at a position where the one of the plurality of circumferentially spaced connecting members meets the peripheral wall, and wherein the wire-guiding slot is spaced from the first side of the housing;

a base coupled to the housing, wherein the base includes a coil unit and a connection port electrically connected to the coil unit; and a power line having an end connected with the connection port of the base and extending from the connection port along the one of the plurality of circumferentially spaced connecting members, the wire-guiding slot, and the corresponding radial line beyond the housing, wherein the permanent magnet has a magnet face facing the coil unit.

2. The fan as claimed in claim 1, wherein the connection port of the base faces the wire-guiding slot of the housing.

3. The fan as claimed in claim 1, wherein an extension is formed at an outer periphery of the base, wherein the extension is coupled to the one of the plurality of circumferentially spaced connecting members and extends toward the wire-guiding slot of the housing, and wherein the connection port is formed on a surface of the extension.

4. The fan as claimed in claim 1, wherein the connection port of the base is located outside of a radially rotational area of the permanent magnet of the impeller, and wherein the connection port is radially between an outer periphery of the permanent magnet and the inner periphery of the peripheral wall of the housing.

5. The fan as claimed in claim 1, further comprising, in combination: a positioning member engaged in the wire-guiding slot, wherein the wire-guiding slot has a first pressing surface, wherein the positioning member has a second pressing surface, and wherein the power line is clamped between the first and second pressing surfaces.

6. The fan as claimed in claim 5, wherein the first pressing surface of the wire-guiding slot includes a first stepped portion and the second pressing surface of the positioning member includes a second stepped portion facing and engaged with the first stepped portion.

7. The fan as claimed in claim 1, wherein a bottom wall is formed inside the peripheral wall and partially defines the cylindrical compartment, and wherein a plurality of catches is formed on the bottom wall and located in the cylindrical compartment, wherein the shaft seat is mounted on the bottom wall and located between the catches, wherein one end of each connecting member connects to the shaft seat through the bottom wall, and wherein the base is mounted in the cylindrical compartment, abutting the bottom wall, and engaged with the plurality of catches.

8. The fan as claimed in claim 1, wherein the coil unit is formed on a surface of the base by layout.

* * * * *